United States Patent [19]

Ashley

[11] 4,102,269

[45] Jul. 25, 1978

[54] LIQUID PROPELLANT WEAPON SYSTEM

[75] Inventor: Eugene Ashley, Burlington, Vt.

[73] Assignee: General Electric Company, Burlington, Vt.

[21] Appl. No.: 778,770

[22] Filed: Mar. 17, 1977

[51] Int. Cl.[2] ..... F42B 5/16; F42B 9/14

[52] U.S. Cl. ..... 102/38 LP; 89/7

[58] Field of Search ..... 102/38 R, 40, 43 R, 102/24 R, 38 LP, 38 CC; 89/7

[56] References Cited

U.S. PATENT DOCUMENTS

| | | | |
|---|---|---|---|
| 2,960,031 | 11/1960 | Clift | 102/38 LP X |
| 3,011,404 | 12/1961 | Russell | 102/38 LP X |
| 3,065,695 | 11/1962 | Jarrett | 102/38 R |
| 3,175,494 | 3/1965 | Turner | 102/38 LP |
| 3,326,084 | 6/1967 | Barbieri et al. | 102/38 R X |

FOREIGN PATENT DOCUMENTS

| | | | |
|---|---|---|---|
| 721,289 | 6/1942 | Fed. Rep. of Germany | 102/40 |

*Primary Examiner*—David H. Brown

*Attorney, Agent, or Firm*—Bailin L. Kuch

[57] ABSTRACT

This invention provides a gun and ammunition system utilizing a liquid propellant traveling charge provided by a cavity generator which programs the dynamics of ignition and combustion.

11 Claims, 2 Drawing Figures

LIQUID PROPELLANT WEAPON SYSTEM

The U.S. Government has rights in this invention pursuant to Contract No. N00123-76-C-0164 awarded by the Department of Defense.

BACKGROUND OF THE INVENTION

1. Field of the Invention

This invention relates to weapon systems employing bulk loaded liquid propellant.

2. Prior Art

The interior ballistics of bulk loaded liquid propellant guns has been the subject of study for a number of years. In my earlier U.S. patent application, Ser. No. 575,283, filed May 7, 1975, now U.S. Pat. No. 4,011,817, I disclosed a mechanical adaptation of the Taylor theory of cavity formation as a means for both controlling the propellant burning rate and achieving a down-bore traveling charge effect. The traveling charge effect is to be achieved through a subcaliber body of revolution placed at the rear of the liquid charge. Termed the "cavity generator", the body of revolution is designed to penetrate the liquid charge during the combustion process and to control the rate at which propellant is supplied to the combustion zone. FIG. 1 illustrates the basic system. A projectile, a propellant charge and a cavity generator are shown at a down-bore position part way through the firing process. Acceleration is to the right. The cavity generator separates the bulk of the liquid charge in front of it from the combustion zone behind it. The cavity generator is less dense than the liquid it displaces. The density difference gives rise to a force which causes the cavity generator to move forward into the liquid. As the cavity generator penetrates the charge, propellant flows rearward in a relative sense into the combustion zone. This action continues until the penetration is complete and all of the propellant has been burned.

SUMMARY OF THE INVENTION

An object of this invention is to provide a gun and ammunition system utilizing a liquid propellant traveling charge provided by a cavity generator which programs the dynamics of ignition and combustion.

A feature of this invention is the provision of a cavity generator having a plurality of longitudinal bores respectively receiving a plurality of rods fixed to the aft end of the combustion chamber. The interengagement of the bores and rods secures the generator, and provides an initiating chamber behind the cavity generator. An ignition system generates hot gas within the initiating chamber to initiate the firing of the round.

BRIEF DESCRIPTION OF THE DRAWING

These and other objects, features and advantages of this invention will be apparent from the following specification thereof taken in conjunction with the accompanying drawing in which.

DESCRIPTION OF THE INVENTION

Figure 1:
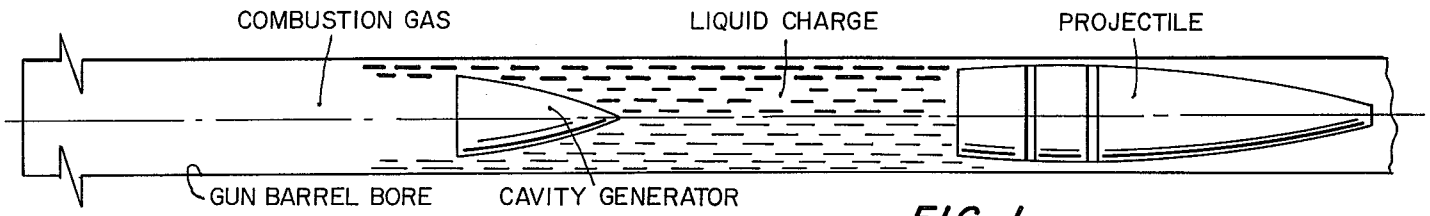
FIG. 1 (PRIOR ART)
FIG. 1 is a schematic view of a gun and ammunition system as disclosed in Ser. No. 575,283.
Figure 2:
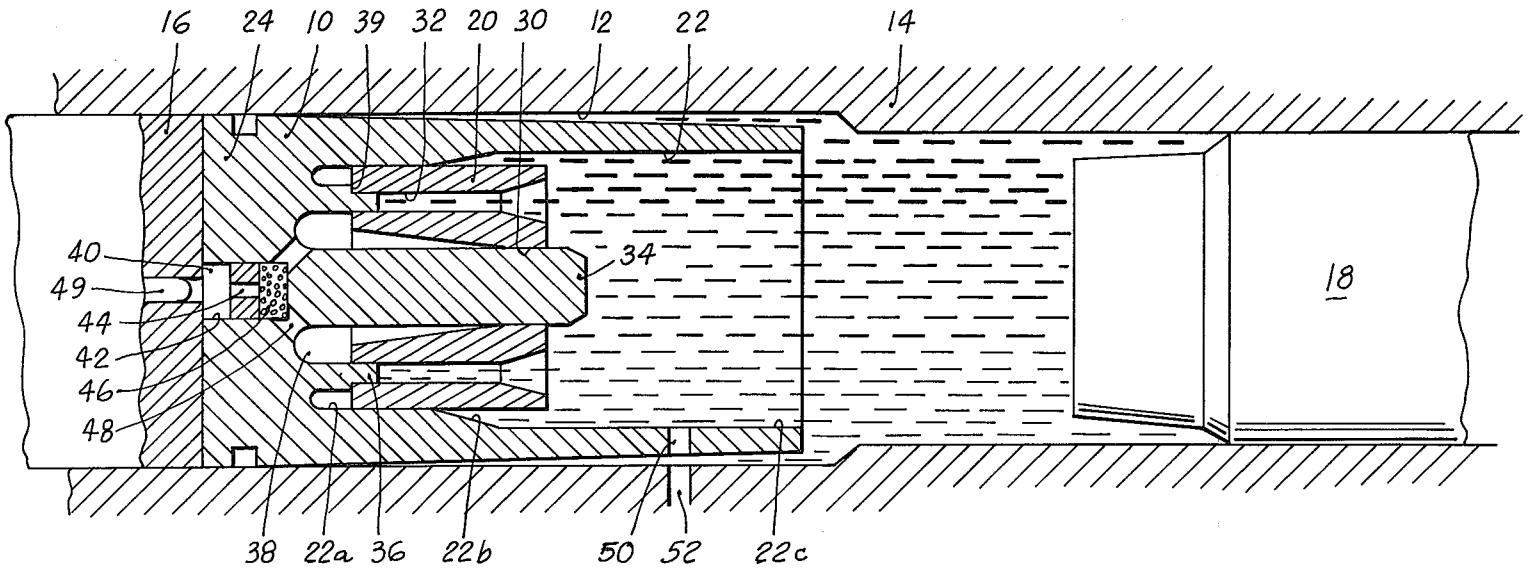
FIG. 2 is a longitudinal cross-section of a gun and ammunition system embodying this invention.

FIG. 2 shows a stub-case, dry loaded, in-the-gun-filled round of ammunition. A stub case 10 is locked into a chamber 12 of a gun barrel 14 by a gun bolt 16. A projectile 18 initially closes the open end of the stub case before propellant is introduced. A cavity generator 20 is disposed within the bore 22 of the case adjacent to but spaced from the base 24 of the case. The bore 22 has a portion of smallest diameter **22*a* adjacent the base 24, a portion of enlarging diameter 22*b*, and a portion of largest diameter 22*c*** adjacent the mouth of the case.

The generator 20 is of generally cylindrical shape and as shown has a central, longitudinally extending, tapered, large diameter bore 30, and plurality of longitudinally extending, smaller diameter bores 32 disposed in an annular row concentric with the bore 30. Additional bores and rows may be provided. A central, large diameter rod 34 extends longitudinally from the base 24, into and through the bore 30, and a like plurality of shorter rods 36, disposed in an annular row, extend longitudinally from the base respectively into the bores 32. The aft face of the generator and the forward face of the base, together with the case side wall and the rods, define an initiating volume or chamber 38. Shoulders 39 may be provided to limit aftward movement of the generator within the case.

A primer 40 is fixed in a cup 42 in the aft face of the base and communicates through a flash bore 44 with a booster charge 46 in the cup, which cup communicates through a plurality of flash bores 48 with the initating volume 38. The primer may be initiated by a firing pin 49 in the bolt 16, and with the booster, serves as an ignition system which provides hot gas to the initiating volume to initiate the firing process.

Liquid propellant is charged into the bore 22 of the case through a port 50 through the side wall of the case from a valving system 52 in the gun. The charge of liquid propellant displaces the projectile forwardly into the bore 54 of the gun barrel 14. Propellant is thus disposed aft of the projectile 18 and forward of the cavity generator 20 and inside any open portion of the bores 32 in the generator forward of the rods 36. The number, pattern and shape of the bores and rods may be varied to control the degree to which the bores remain filled with gas, as will be explained later. By means of their interfitting with the bores in the generator, the rods support the generator at the rear of the case before firing and also serve to separate the liquid propellant from the initiating volume.

The firing sequence is as follows:

1. The primer 40 is fired, igniting the booster charge 46, to fill the initiating volume 38 with hot gas.
2. At first the cavity generator 20 acts like a simple piston. It begins to move forwardly, compressing the propellant, pushing the projectile forward so that the forcing cone and rifling engrave the rotating band of the projectile to begin the accelerating process. The length of the rods prevent the exposure of liquid propellant to the hot gas.
3. Subsequently, the cavity generator moves off the shortest rods (36) to expose propellant to the hot gas. Combustion of the adjacent propellant commences. This propellant will generate combustion gasses behind the cavity generator to further the piston action of the cavity generator in the accelerating process.
4. Finally, the large diameter center hole, which is intentionally filled with gas by making it tapered, begins to progress off the center rod. The hot gas will go out forwardly because the column of liquid ahead of it is short. The main combustion bubble from the central bore, and possibly additional bubbles from the smaller bores, if the smaller bores are also tapered, advance forwardly into the main charge of liquid propellant, leaving the cavity generator behind in the stub case. The generator is ultimately extracted with the case.

In this manner the size, number and sequence in time of the combustion bubbles or cavities entering the main charge of liquid propellant can be controlled.

What is claimed is:

1. A round of ammunition comprising:
a projectile having a first average density;
a cavity generator having a second average density;
a charge of liquid propellant having a third average density which is greater than said second average density; and
a cartridge case;
said cavity generator having a forward face, an aft face, and a passageway extending longitudinally therebetween; and
said cartridge case having means for obturating said passageway.

2. A round of ammunition according to claim 1 wherein:
said cartridge case has a base with an interior forward face;
said cavity generator is disposed with its aft face forward of and spaced from said case base face, and therebetween defining an initiating volume.

3. A round of ammunition according to claim 2 wherein:
said cavity generator includes an additional passageway extending longitudinally between said forward and aft faces of said cavity generator; and
said cartridge case includes an additional means for obturating said additional passageway; and
further including
means for supplying hot gas into said initiating volume, for advancing said cavity generator from a first station whereat said first mentioned passageway is closed by said first mentioned obturating means and said additional passageway is closed by said additional obturating means, to a second station whereat said additional passageway is opened by said additional obturating means and liquid propellant passes through said additional passageway into said initiating volume and is ignited by said hot gas, and thereafter, to a third station whereat said first mentioned passageway is opened by said first mentioned obturating means and hot gas passes through said first mentioned passageway from said initiating volume into said liquid propellant charge.

4. A round of ammunition according to claim 3 wherein:
said first mentioned passageway has a decreasing cross-sectional area from said aft face to said forward face of said cavity generator; and
said first mentioned obturating means is a longitudinally extending rod having a substantially uniform cross-sectional area along its length.

5. A round of ammunition according to claim 3 wherein:
said first mentioned passageway comprises a substantially conical bore of decreasing cross-sectional area from said aft face to said forward face of said cavity generator; and
said first mentioned obturating means is a longitudinally extending cylindrical rod of substantially uniform cross-sectional area along its length.

6. A round of ammunition according to claim 2 further including:
means for supplying hot gas into said initiating volume, for advancing said cavity generator forwardly from a first station whereat said passageway is closed by said case obturating means to a second station whereat said passageway is opened by said case obturating means and liquid propellant passes through said passageway into said initiating volume and is ignited by said hot gas.

7. A round of ammunition according to claim 2 further including:
means for supplying hot gas into said initiating volume, for advancing said cavity generator forwardly from a first station whereat said passageway is closed by said case obturating means to a second station whereat said passageway is opened by said case obturating means and hot gas passes therethrough from said initiating volume into said liquid propellant charge.

8. A round of ammunition according to claim 7 wherein:
said first and second stations of said cavity generator are longitudinally spaced apart within said cartridge case.

9. A round of ammunition according to claim 8 wherein:
said passageway in said cavity generator tapers from a relatively larger diameter at said aft face to a relatively smaller diameter at said forward face.

10. A round of ammunition according to claim 5 wherein:
said cavity generator includes a first plurality of additional passageways extending longitudinally between said forward and aft faces of said cavity generator; and
said cartridge case includes a second plurality, equal to said first plurality, of additional means for respectively obturating each of said additional passageways.

11. A round of ammunition according to claim 10 wherein:
said first station of said cavity generator is identical for said first mentioned passageway and said first plurality of additional passageways; and
said first plurality of additional passageways is opened by said second plurality of additional case obturating means at an intermediate station disposed longitudinally between said first station and said second station.

* * * * *